United States Patent [19]

Fischer

[11] 4,377,112

[45] Mar. 22, 1983

[54] DEFLECTION-COMPENSATED SHEET GRIPPER ARRANGEMENT FOR ROTARY PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 231,158

[22] Filed: Feb. 3, 1981

[30] Foreign Application Priority Data

Feb. 6, 1980 [DE] Fed. Rep. of Germany ..... 3004273

[51] Int. Cl.[3] ..... B41F 21/04

[52] U.S. Cl. ..... 101/246; 101/409

[58] Field of Search ..... 101/409, 410, 411, 412, 101/408, 230, 246; 74/526

[56] References Cited

U.S. PATENT DOCUMENTS

| | | | |
|---|---|---|---|
| 539,356 | 5/1895 | Cox | 101/264 |
| 3,125,022 | 3/1964 | Reinartz et al. | 101/410 X |
| 3,534,683 | 10/1970 | Barthel | 101/410 X |

FOREIGN PATENT DOCUMENTS

| | | | |
|---|---|---|---|
| 2808528 | 9/1979 | Fed. Rep. of Germany | 101/409 |

*Primary Examiner*—Edgar S. Burr
*Assistant Examiner*—Charles Pearson
*Attorney, Agent, or Firm*—Frishauf, Holtz, Goodman & Woodward

[57] ABSTRACT

To permit axial excursion of the gripper spindle (2) with respect to the shaft (6) of a transfer drum or printing cylinder upon bend-through of the shaft, a spindle axial alignment element (13) is located approximately centrally of the gripper spindle (2) which is axially maintained in position by being engaged, at both axial sides, by guide rollers (14, 15) secured to the shaft (2). Thus, the gripper spindle is axially aligned with respect to the shaft essentially at the center thereof. The axial alignment element (13) in form of a plate between the rollers (14, 15) is shorter by a distance (*d*) than the radial distance between the shaft (6) and the gripper spindle (2) to permit radial excursion of the shaft (6) which occurs particularly at high printing speeds, thereby preventing transfer of forces on the gripper spindle (2) upon bend-through of the shaft (6). The lateral bearings (4, 5) are floating bearings, permitting angular and axial excursion of the gripper spindle with respect to the support elements (17, 18) supporting the bearings on the shaft.

7 Claims, 3 Drawing Figures

DEFLECTION-COMPENSATED SHEET GRIPPER ARRANGEMENT FOR ROTARY PRINTING MACHINE

Figure 1A:
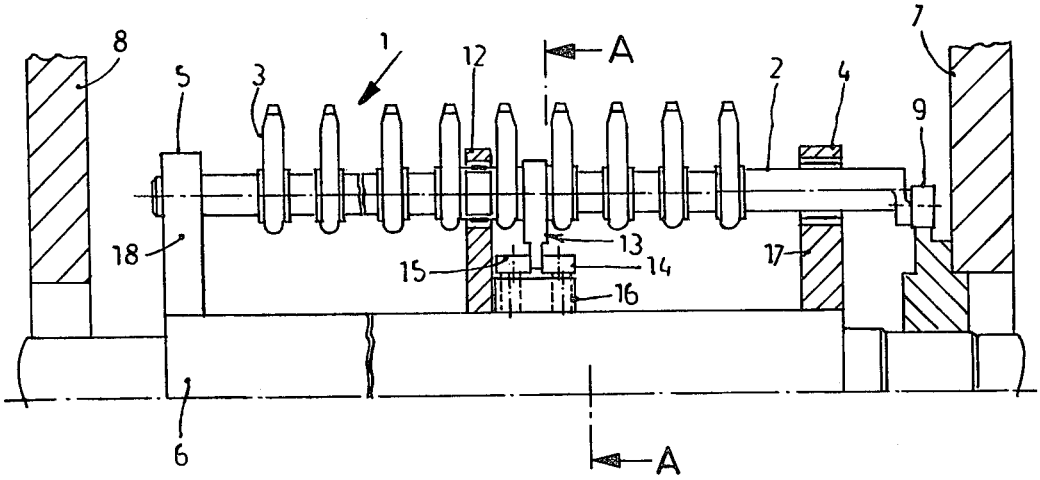

The present invention relates to rotary printing machines, and more particularly to a sheet gripping arrangement which is compensated for deflection of a shaft to which the gripper arrangement is attached, suitable for example for use in printing cylinder drums, transfer drums, and the like.

BACKGROUND

Various types of sheet gripper arrangements are known and in general use in rotary printing machines in order to transfer sheets from one drum or cylinder to another. One such gripper system is described in the "M.A.N. Printing Machinery News", vol. 51, page 28. This system, similar to other systems, as customary, has gripper fingers coupled to a gripper spindle, cooperating with gripper surfaces which are positioned on a gripper rail, part of or carried on the drum to which the gripper is attached. As customary, the gripper spindle is journaled at the axial ends in spindle carriers which are rigidly secured to the cylinder shaft. Positioning rings are located adjacent the carriers, usually at the outer axial ends, to position the gripper spindle, without play, in axial alignment. The grippers, and hence the gripper spindle, must be properly aligned so that no differences in register will occur upon printing. Lateral deflection or deviation of the gripper spindle in axial direction with respect to the associated cylinder of the printing machine, may cause doubling or register misalignment, and axially fixing the gripper spindle is thus required. It has been found that grippers in printing machines operating at high speed, and hence transporting printed substrates at high speeds have different holding forces in different ranges of the gripper spindle. The holding forces between the gripper fingers and the matching gripper pads or rails can vary so much that the substrate may be pulled out from the grippers, or misalignment may result. Some zones across the printed sheet which are gripped, thus, may have lesser gripper force than others. In a worst case situation, the substrate may separate entirely from the grippers.

THE INVENTION

It is an object to provide a sheet gripper arrangement which is particularly suitable for use with rotary printing presses operating at high speed, and which insures uniform gripper pressure throughout the axial length of the gripper spindle, so that differential gripper forces will not arise.

Investigations to determine the reason for differences in gripper forces have found that, apparently, the reason for the differential gripping forces of grippers in high-speed machinery is the bend-through of the cylinder or gripper drum shafts which may become considerable at high rotary speeds. The bend-through, due to the substantial mass of the shafts, is then transferred to the gripper spindle over the gripper spindle carriers which are rigidly secured to the shafts and, due to the lateral positioning of the gripper spindle in the carriers, the gripper spindle is drawn into the undesired deformation of the shaft. As a consequence, zones of lesser gripper force will occur across the axial length of the gripper shaft.

Accordingly, the present invention is directed to solving problems which arise when the shaft of the cylinder or drum which carries the gripper bends through, for example due to high operating speed.

Briefly, the gripper shaft is carried on the shaft of the cylinder or drum as before but not restrained axially in the carrier. An additional axial alignment coupling element, preferably located approximately centrally of the shaft is provided, secured to the shaft, and in engagement with an axial alignment coupling element coupled to the gripper spindle to provide for axially positive alignment. The axial positioning between the spindle and the shaft, thus, is transferred to, preferably, approximately the center of the shaft, with the end portions being free to deflect. The alignment element is so constructed that clearance or dead motion or lost motion with respect to a radial direction is possible so that bend-through of the shaft will not be transferred to the gripper spindle.

The system has the advantage that the gripper spindle is axially positioned with respect to the shaft at only a single point, preferably approximately in the central range of the gripper spindle, the end portions of the gripper spindle being free to move axially with respect to the shaft in bearings which permit axial movement. Thus, if the cylinder shaft deflects, by bend-through, and the gripper spindle carriers at the lateral sides of the shaft also deflect, which will be in an outward direction, the gripper spindle itself will not be gripped thereby and drawn into the deformation. The gripper spindle may retain its longitudinal alignment, while remaining axially fixed with respect to a central reference point, thus insuring axial alignment of the gripper spindle in the desired position, taking over sheets being fed thereto in properly aligned and registered position for further transport. The gripping pressure of the gripper fingers against the respective counter surfaces, typically pressure pads on a rail, will be essentially uniform throughout the axial extent of the gripper cylinder or drum.

DRAWINGS

Figure 1B:
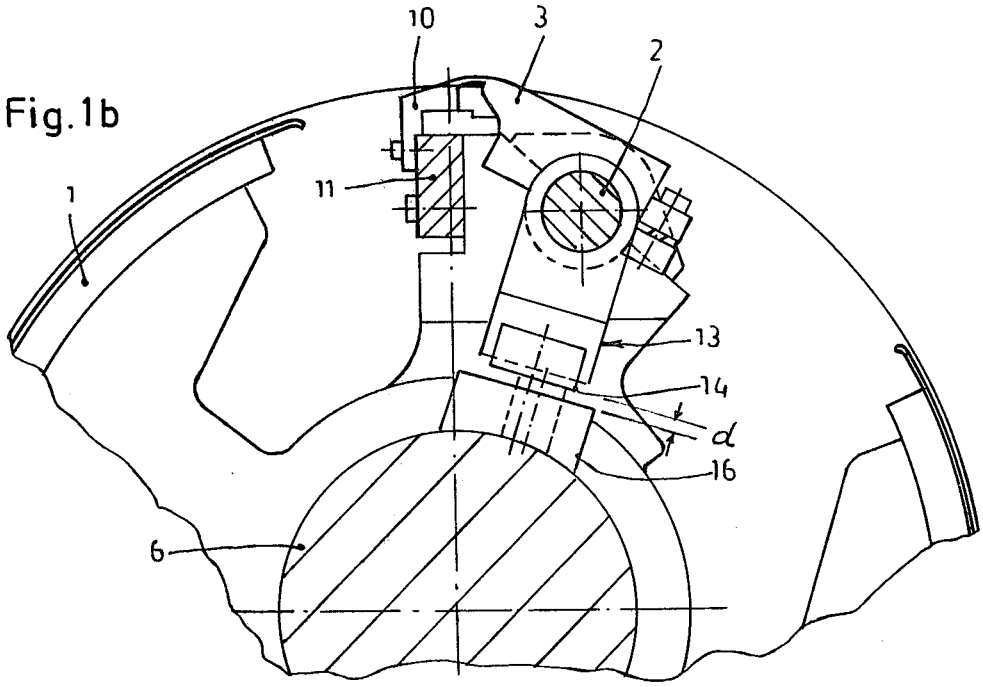
Figure 2:
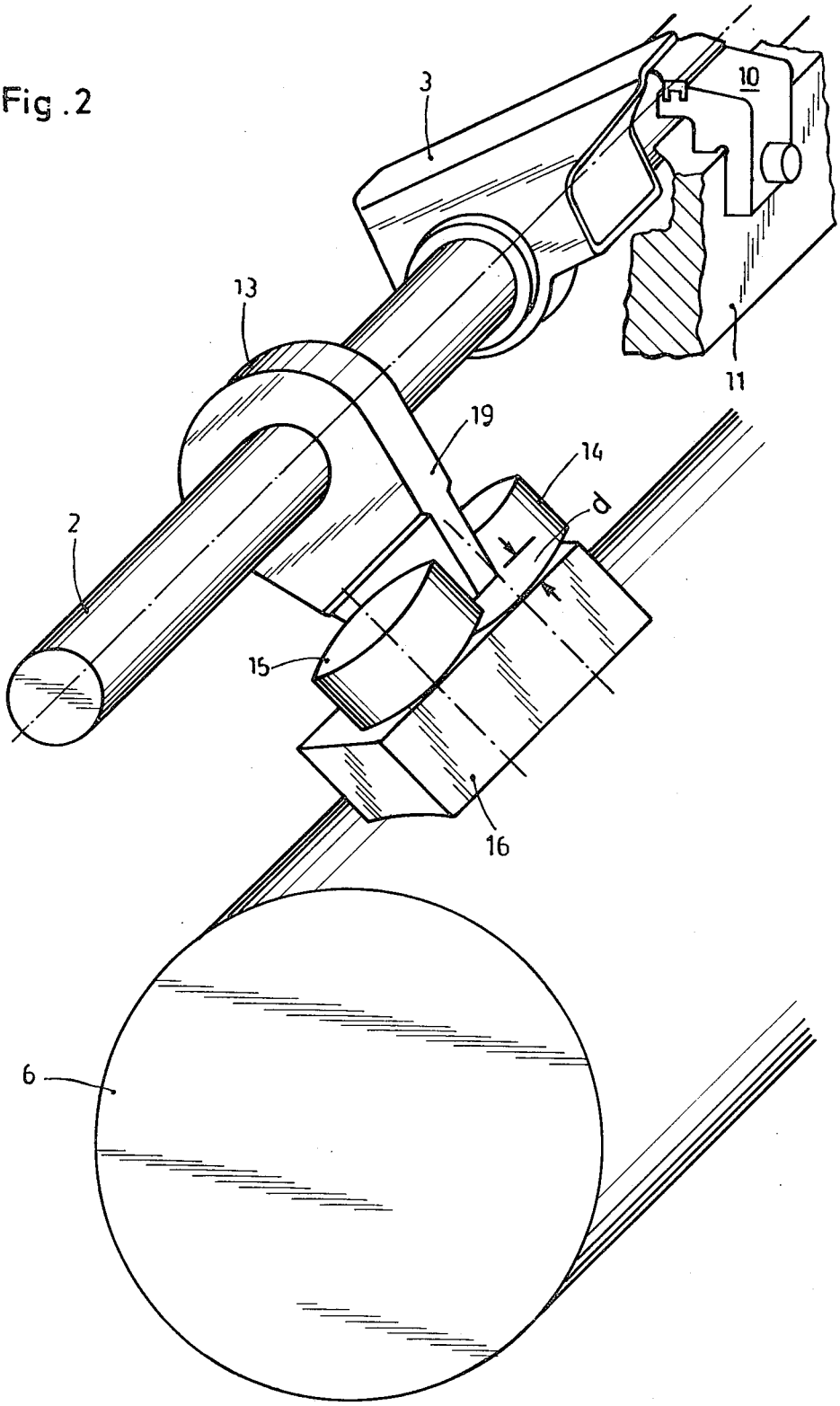

FIG. 1*a* is a highly schematic longitudinal view, partly in section, through a sheet gripper arrangement;

FIG. 1*b* is a cross section along the line A—A of the gripper arrangement of FIG. 1*a*; and FIG. 2 is a perspective view, to an enlarged scale, of the sheet gripper device in accordance with FIGS. 1*a* and 1*b*, and illustrating the central axial positioning thereof on a transfer drum in a rotary printing machine.

The printing cylinder 1 has a pivotable gripper spindle on which a plurality of gripper fingers 3 are located. The gripper fingers 3, upon pivoting of the gripper spindle 2, fit against counter surfaces, for example pads, secured to brackets 10 and attached to a rail 11 (see FIG. 2).

This portion of the structure can be standard and in accordance with any well known sheet gripper arrangement.

The gripper spindle 2 is held at both axial ends in bearings 4, 5. The bearings 4, 5 permit axial excursion of the gripper spindle 2 and rotation or pivoting thereof with respect to bearing supports 17, 18, secured to a shaft 6. The bearings 4, 5 may, for example, be slide or journal bearings, or floating ball bearings, for example ball bearings which have a part-spherical outer surface of the outer race to permit self-alignment upon change of the angle of the shaft of the gripper 2 with respect to the support 18 from a nominal right angle to a slightly changed angle upon deflection of the shaft 6. The sheet gripper arrangement is located on the cylinder shaft 6 which, in customary manner, is journaled at the right and left side walls 7, 8 of the machine in bearings (not shown) in accordance with standard printing machine practice. Upon rotation of the printing cylinder 1, the grippers 3 are operated to open and close by engagement of a cam roller 9 with a stationary cam track. The grippers, thus, are rhythmically caused to engage the counter surfaces 10 on the rail 11 or to be lifted off therefrom.

Sheets, thus, are transported in properly positioned alignment in synchronism with the instantaneous angular position of the cylinder to insure appropriate sheet transport throughout the machine. If the shafts have a long axial extent so that, also, the gripper spindles will be long, an intermediate bearing 12 to support the gripper spindle may be desirable. This bearing 12 should be rather loose.

In accordance with the present invention, and in order to prevent transfer of bend-through effects of the cylinder shaft 6 on the gripper spindle 2, a gripper spindle alignment arrangement is provided, positioned approximately centrally of the gripper spindle 2. The alignment arrangement has a part 13, best seen in FIG. 2, which is secured to the gripper spindle. The part 13 is essentially in plate or strip form and has a lower portion 19 which is guided between two guide rollers 14, 15 which, in turn, are secured to a roller attachment block 16 which is secured on the cylinder shaft 6. The gripper spindle 2 thus can pivot under control of the cam follower 9 on the fixed cam, while being axially positioned by engagement between the rollers 14, 15 with the plate-like projection 19 of the axial guide element 13.

The plate element 19 is spaced from the top surface of the block 16 by some distance d, which is slightly greater than the maximum excursion of the cylinder shaft 6. Thus, if the cylinder shaft 6 deflects, forces cannot be transferred through the spindle carriers 17, 18, rigidly secured to the shaft 6 on the gripper spindle 2, since the carriers 17, 18 can deflect with respect to the spindle 2, for example upon bend-through of the cylinder axis upwardly in FIG. 1*a*, causing deflection of the carriers 17, 18 outwardly, towards the left and right. By axially positioning the gripper spindle 2 with respect to a reference location, preferably approximately the center of the shaft, the gripper fingers will retain a predetermined defined position with respect to sheets to be fed thereto.

Since the element 19 extends only partially between the guide rollers 14, 15, bend-through of the shaft 6 upwardly, that is, in the direction of the gripper spindle 2, will not be transferred through the element 13 to the spindle 2 itself. The rollers permit ready pivoting of the shaft, that is, rocking of the element 13 with respect to the rollers.

The element 13 could be rigidly attached to the cylinder shaft 6, rather than placed between two rollers 14, 15, if means are provided to insure that the gripper spindle 2 can rotate or rock within the element 13 without permitting axial shifting and without transfer of radially deflecting forces to the gripper spindle. For example, the element 13 may include a bearing surrounding the shaft 2 and having an outer bearing part which is slidable in an elongated or oval opening formed in a bracket secured to the shaft 6, and otherwise essentially similar to the element 13, as illustrated. The arrangement, thus, can be reversed with radially deflecting movement being compensated by an element, for example a bearing, surrounding shaft 13 by providing clearance space similar to the dimension d (FIGS. 1*b*, 2) with respect to the embodiment shown in the drawings, which is a simple, reliable and inexpensive construction and preferred for reasons of economy and simplicity.

Various changes and modifications may be made within the scope of the inventive concept.

I claim:

1. In a rotary printing machine having a cylinder shaft (6), frame means (7, 8) rotatably supporting the shaft, a deformation-compensated sheet gripper arrangement having a gripper spindle (2), means (17, 18) supporting the spindle on the shaft secured to the shaft and located adjacent respective axial ends of the gripper spindle;

a plurality of gripper fingers (3) carried by the gripper spindle, and comprising, in accordance with the invention, means insuring axial alignment of the gripper spindle (2) and hence of the grippers thereon with respect to a reference position on the shaft while permitting pivoting of the gripper spindle with respect to the shaft while the shaft is rotating comprising axial alignment means for providing an axially predetermined position of the spindle (2) and hence the gripper fingers (3) thereon with respect to the shaft (6) including a first axially fixed coupling means (13) secured to the spindle;

a second axially fixed coupling means (14, 15, 16) secured to the shaft;

and an axially positive coupling connection between said first and second coupling means, said coupling connection serving to maintain the axial position of the gripper spindle (2) with respect to the cylinder shaft (6) while permitting relative pivoting or rocking of the gripper spindle with respect to the shaft and, additionally, providing for clearance (d) and permitting relative motion in radial direction;

and axially floating bearing means (4, 5) secured to said spindle support means (17, 18) and journaling said gripper spindle (2) while permitting relative excursion of the gripper spindle with respect to the shaft at the positions of said spindle support means.

2. Arrangement according to claim 1, wherein the first coupling means (13) comprises an axial alignment element secured to the gripper spindle (2);

the second coupling means comprises an engagement means (14, 15, 16) located on the cylinder shaft (6) engaging the alignment element and positioning said element in axial direction—relative to the cylinder shaft—with respect to the coupling means.

3. Arrangement according to claim 1, wherein the first and second coupling means are located approximately in the central region of the gripper spindle (2).

4. Arrangement according to claim 1, 2 or 3, wherein said first coupling means (13) comprises a plate or strip-like arm extending radially from the gripper spindle (2) towards said shaft (6);

and said second coupling means (14, 15, 16) comprises two guide elements (14, 15) positioned at axially oppostie sides of said plate or strip-like arm and providing axial guidance therefor.

5. Arrangement according to claim 4, wherein said plate or strip-like arm is rigidly secured to the gripper spindle (2);

and said guide elements comprise rollers (14, 15) having rolling surfaces forcing the plate or arm between which said plate or strip-like arm (13) is positioned to guide said arm in axial direction while permitting movement between said rollers.

6. Arrangement according to claim 5, wherein the plate or strip-like arm is shorter than the undeflected distance between the cylinder shaft and the gripper spindle to permit relative axial deflection between the shaft and spindle and provide for said clearance (d) and said relative motion.

7. Arrangement according to claim 1 or 2, wherein the bearing means (4, 5) are floating bearings permitting self-alignment of the gripper spindle (2) with respect to said support means (17, 18) and axial excursion of the gripper spindle (2) with respect to said spindle support means.

* * * * *